US010843027B2

(12) United States Patent
Wang

(10) Patent No.: US 10,843,027 B2
(45) Date of Patent: Nov. 24, 2020

(54) ADJUSTABLE DUMBBELL

(71) Applicants: Huaiqi Wang, Tianjin (CN); ISPORT TECHNOLOGY (TIANJIN) CO., LTD, Tianjin (CN)

(72) Inventor: Huaiqi Wang, Tianjin (CN)

(73) Assignees: Tianjin IFIT Technology Co., Ltd., Tianjin (CN); Huaiqi Wang, Tianjin (CN)

( * ) Notice: Subject to any disclaimer, the term of this patent is extended or adjusted under 35 U.S.C. 154(b) by 10 days.

(21) Appl. No.: 15/730,738

(22) Filed: Oct. 12, 2017

(65) Prior Publication Data

US 2018/0264308 A1 Sep. 20, 2018

(51) Int. Cl.

| | |
|---|---|
| ***A63B 21/075*** | (2006.01) |
| ***A63B 71/00*** | (2006.01) |
| ***A63B 21/072*** | (2006.01) |
| *A63B 71/06* | (2006.01) |

(52) U.S. Cl.

CPC ..... *A63B 21/075* (2013.01); *A63B 21/0726* (2013.01); *A63B 21/0728* (2013.01); *A63B 71/0036* (2013.01); *A63B 2071/0694* (2013.01)

(58) Field of Classification Search

CPC ..... A63B 21/075; A63B 21/0726; A63B 21/0728; A63B 71/0036; A63B 2071/0694

See application file for complete search history.

(56) References Cited

U.S. PATENT DOCUMENTS

| | | | | |
|---|---|---|---|---|
| 8,715,143 | B2 * | 5/2014 | Svenberg | A63B 21/0728 482/108 |
| 8,790,223 | B2 * | 7/2014 | Wang | A63B 21/0726 482/106 |
| 9,504,868 | B2 * | 11/2016 | Liu | A63B 21/0726 |
| 9,776,032 | B2 * | 10/2017 | Moran | A63B 21/075 |
| 9,814,922 | B2 * | 11/2017 | Moran | A63B 21/075 |
| 9,895,571 | B2 * | 2/2018 | Wang | A63B 21/075 |
| 9,956,451 | B1 * | 5/2018 | Wang | A63B 21/075 |
| 10,022,583 | B2 * | 7/2018 | Wang | A63B 21/075 |
| 10,195,477 | B2 * | 2/2019 | Marjama | A63B 71/0036 |
| 2015/0360073 | A1 * | 12/2015 | Moran | A63B 21/075 482/107 |

* cited by examiner

*Primary Examiner* — Megan Anderson
(74) *Attorney, Agent, or Firm* — George G. Wang; Bei & Ocean

(57) ABSTRACT

Weight-adjustable dumbbell having a handle bar and two weight plate holders each connected to one end of the handle bar, and the dumbbell is capable of changing its weight by simply rotating the handle relative to the weight plate holders to one of the predetermined positions corresponding to various weights.

9 Claims, 29 Drawing Sheets

ADJUSTABLE DUMBBELL

TECHNICAL FIELD

The present invention relates to dumbbells and, more particularly, to an adjustable dumbbell.

BACKGROUND OF THE PRESENT INVENTION

Traditional dumbbells are of fixed weights, such as 2, 10, 20 and 30 kg. However, in order to exercise different body parts at different exercise intensities or different exercise stages, a user needs to be equipped with a set of dumbbells with different weights, resulting both in increasing the spending on equipment purchase and in that the equipment is not easy to store and carry.

There is also a conventional adjustable dumbbell in the market, which consists of a dumbbell bar, a number of detachable weight plates and two spring sleeves (or nuts). When adjusting the weight, the spring sleeves at both ends are disassembled first, and then the weight plates are attached or detached, and finally the spring sleeves are assembled.

Although the above adjustable dumbbell achieves weight adjustable, it is cumbersome and time-consuming to adjust the weight plates by manually adding and decreasing the weight plates; and the adjusted weight plate is also required to be calculated manually so that the weight of dumbbell cannot be displayed directly.

SUMMARY OF THE PRESENT INVENTION

The objectives of the present invention are to overcome the technical shortcomings in prior art and to provide an adjustable dumbbell which is simple structure, small size and a large number of adjustable levels and is safe and reliable, and easy to use, store and carry.

In order to achieve the above-mentioned objectives, a technical solution employed in the present invention is as follows:

An adjustable dumbbell is provided, including a dumbbell bar, wherein the dumbbell bar comprises a rotatable handle having a support plate fixed at each end thereof; a cylindrical convex plate is arranged in the middle of each end face of the support plate, an inner through hole is formed between the handle and the cylindrical convex plate, and the end face of each support plate is connected to a circular locating plate having a center hole in the middle by a fixture; a locating structure is connected between the support plate and the locating plate, the cylindrical convex plate is plugged into the center hole, sectors distributed uniformly with consistent level and number of weight plates are arranged on the circular locating plate, and each sector is provided with a connection structure corresponding to the weight level, and the connection structure comprises locating holes uniformly distributed in each sector at the periphery of the center hole; when the weight level corresponding to the sector is not the highest weight level, sets of pin holes are respectively formed on the sectors corresponding to the weight levels which are not the highest, the number of the pin holes in each set of pin holes is consistent with that of the weight plates which are not connected to the side; a level tag is fixed on the periphery of the support plate; two weight plate holders are arranged on outer sides of the circular locating plates and are in clearance fit with end faces of the circular locating plates, and each weight plate holder comprises a main body which is arranged along the axial direction of the circular locating plate and comprises a plurality of U-shaped separation ribs bilaterally and interval arranged in parallel; tops of the U-shaped separation ribs are fixedly connected to each other by a connection wall, a U-shaped groove is formed between two U-shaped separation ribs, and a weight level indicator is arranged on the connection wall close to one side of the locating plate; when rotating the handle, the level tag rotates to a position corresponding to the weight level indicator, i.e., the corresponding weight level; two locating pins in which locating holes are formed in the middle are symmetrically arranged on an end face of the main body corresponding to the circular locating plate, a ball compression spring and a ball are mounted in each locating hole, the diameter of the ball is larger than the aperture of the locating holes of the locating plate, and the balls partly fall into the locating holes at a corresponding position under the action of the ball compression springs for location, and then roll out of the locating hole when the rotating force for rotating the handle is larger than the jacking force of the compression spring; a connector is arranged in the grooves inside the U-shaped separation ribs along the axial direction of the main body, a middle through hole arranged coaxially with an inner hole is formed in the connector, a mandrel in a circumferential clearance fit with the inner hole passes through the inner hole and the middle through hole, a shaft end face of the cylindrical convex plate is attached to an end face of the connector; the weight plate holders on the both sides are fixed on the mandrel at the same angle, a slide rail is arranged on a top surface of the connector along the axial direction of the main body, a pin cartridge hole is formed in the groove inside the U-shaped separation rib above the slide rail, and set of the pin cartridges mounted in the pin cartridge hole are capable of gliding in the pin cartridge hole and being connected to the main body by a locking structure; grooves are symmetrically formed on front and rear side walls of the pin cartridge hole corresponding to each U-shaped separation rib respectively; each set of the pin cartridge comprises a bottom pin cartridge cover on which an upper pin cartridge cover is fixed, pin holes of which the number is the same as that of the weight plates on one side are formed on a side wall of the upper pin cartridge cover, a plurality of support walls are interval arranged in parallel inside the bottom pin cartridge cover and arranged along the axial direction perpendicular to the main body; chambers, which the number is the same as that of the pin holes, are formed between the adjacent support walls; spring locating pins, each being fixedly connected to a locating pin by a pin bottom compression spring, are arranged on a side wall of each support wall corresponding to the pin hole, a pin head is fixed at one end of each locating pin in the horizontal direction and a pin bottom is fixed at the other end thereof, the pin head and the pin bottom are perpendicular to each other; pin bottom grooves are respectively formed at the positions on front and rear side walls of the bottom pin cartridge cover corresponding to each chamber, and each locating pin is supported on the corresponding pin bottom groove by the pin bottom; the length of the pin bottom is larger than the width of the bottom pin cartridge cover so that front and rear ends of the pin bottom extend respectively from the pin bottom groove on the corresponding side; the width of the pin bottom groove is larger than that of the pin bottom, and the pin heads of the locating pins are capable of passing through the pin holes each to each under the elasticity of the pin bottom compression spring and being arranged correspondingly to a set of pin holes in one sector on the locating plate; when the pin bottom compression spring is in a normal state, the pin bottom of each locating pin is respectively plugged into the groove of the U-shaped separation rib at the corresponding position; when the pin bottom compression spring is in a compressed state, the pin bottom of the locating pin connected to the compressed pin bottom compression spring is moved to the position between the two U-shaped separation ribs along the pin bottom groove and plugged into weight plate grooves corresponding thereto on the weight plates, so that the locating pins are fixedly connected to the weight plates; locating pins are arranged on an end face of the bottom pin cartridge cover at the same end as the pin holes, and when the balls fall into the locating holes corresponding thereto on the locating plate, the locating pins are plugged into, locked with and connected to the locating holes corresponding thereto on the locating plate; the U-shaped separation ribs at both ends are plugged each to each between the two adjacent weight plates of the weight plate sets at both ends, the weight plates are clamped between the separation ribs on the both sides, the axial movement and the radial rotation of the weight plates are both located; a U-shaped weight plate groove is arranged in the middle of an upper portion of each weight plate, and weight plate grooves are symmetrically formed on front and rear vertical side walls of each U-shaped weight plate groove; a horizontal support surface is arranged on a bottom wall of the weight plate, the weight plates in the weight plate sets are supported each to each in a plurality of arc-shaped grooves of the base by the horizontal support surface at the bottom, and each weight plate is clamped in the correspondingly arranged arc-shaped grooves of which the shape is matched with that of the bottom of the weight plate so that all the U-shaped weight plate grooves are completely overlapped along the axial direction.

The present invention has the following advantages and positive effects:

1. All the weight plates are placed on the base and can be attached or detached without manual removal;

2. the lifting weight can be adjusted by releasing the set of the pin cartridges at the both ends and rotating the handle;

3. the handle is equipped with weight tags, so that the weight can be adjusted more intuitively.

BRIEF DESCRIPTION OF THE DRAWINGS

FIG. 11-1 is a schematic diagram of the set of the pin cartridge;

FIG. 11-2 is a section view of the set of the pin cartridge;

FIG. 12-1 is a left view of the weight plate holder of FIG. 12;

FIG. 12-2 is a top view of the weight plate holder of FIG. 12;

FIG. 12-3 is a perspective view of the weight plate holder;

FIG. 17-1 is a schematic diagram of the weight plate assembled by a plurality of pieces;

DETAILED DESCRIPTION OF THE PRESENT INVENTION

The present invention will be further described as below with reference to the accompanying drawings by the specific embodiments.

As shown in the figures, an adjustable dumbbell according to the present invention comprises a dumbbell bar 1, wherein the dumbbell bar 1 comprises a rotatable handle 5 having a support plate fixed at each end thereof; a cylindrical convex plate 31 is arranged in the middle of an end face of the support plate, an inner through hole 34 is formed between the handle 5 and the cylindrical convex plate 31.

Figure 4:
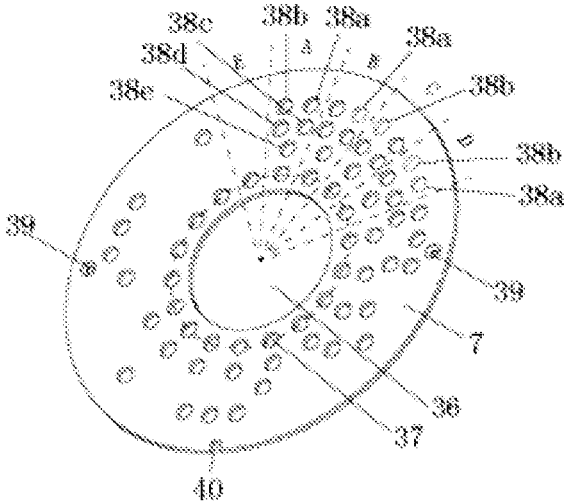
FIG. 4 is a schematic diagram of locating plates of the dumbbell according to the present invention.

The end face of each support plate is connected to a circular locating platelocating plate 7 having a center hole 36 in the middle by a fixture, and a locating structure is connected between the support plate and the locating plate 7. The cylindrical convex plate 31 is plugged into the center hole 36, sectors distributed uniformly with consistent level and number of weight plates (e.g., there are four weight levels as 30 kg, 20 kg, 10 kg and 2 kg in the locating plate, and the locating plate is equal divided into four sectors) are arranged on the circular locating plate, and each sector is provided with a connection structure corresponding to the weight level, and the connection structure comprises locating holes 37 uniformly distributed in each sector at the periphery of the center hole 36. When the weight level corresponding to the sector is not the highest weight level, the sets of pin holes are respectively formed on the sectors corresponding to the weight levels which are not the highest, the number of the pin holes in each set of pin holes is consistent with that of the weight plates which are not connected to the side (i.e., the weight plates which are not connected to the dumbbell bar 1 when the dumbbell is lifted up); as shown in FIG. 4, the numbers of the pin holes in each of the set of pin holes A, B, C, D and E are different. If the group A is provided with five pin holes 38*a*, 38*b*, 38*c*, 38*d* and 38*e* (determined according to the number of the weight plates to be connected to each end) and the group B is provided with four pin holes 38*b*, 38*c*, 38*d* and 38*e*, the pin hole 38*a* (represented by dotted line) at the same position is hidden. Similarly, the pin hole 38*b* (represented by dotted line) in the group C is hidden, the pin holes 38*a* and 38*b* (represented by dotted line) in the group D are hidden, and all the pin holes in the group E are hidden. A level tag 19 is fixed on the periphery of the support plate. As one embodiment, a circular groove 30 in which the level tag 19 may be mounted on is arranged on the periphery of each support plate.

Figure 5:
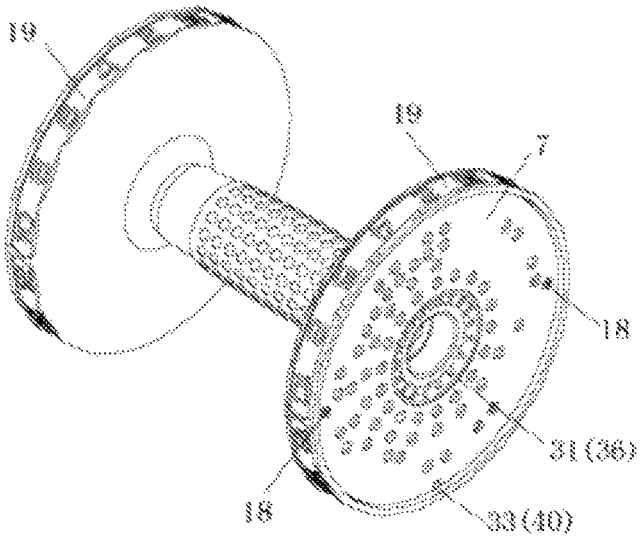
FIG. 5 is a structural diagram of the handle mounted with the locating plates and weight level tags of the dumbbell according to the present invention.

As shown in FIG. 5, at least two screw holes 32 are formed on the end face of each support plate, and screw holes 39, which are in one-to-one correspondence to the screw holes 32, are formed on the locating plate 7, and the screw holes 32 are fixedly connected to the screw holes 39 corresponding thereto by screws 18. Other existing fixing structures may also be adopted.

As a preferred embodiment of the present invention, the locating structure comprises a locating shoulder 33 arranged on the end face of the support plate, a notch 40 corresponding to the locating shoulder 33 is formed on the locating plate 7, and the locating shoulder 33 is plugged into the notch 40 for location. In this way, accurate correspondence between the sectors and figures on the level tag 19 on the support plate may be achieved. Alternatively, the structure of the level tag 19 corresponding to the sector may also adopt locating pins and locating holes which are matched with each other, and other existing structures.

Two weight plate holders 6 are arranged on the outsides of the circular locating plates 7 and are in clearance fit with end faces of the circular locating plates 7, and each weight plate holder 6 comprises a main body which is arranged along the axial direction of the circular locating plate 7, and the main body comprises a plurality of U-shaped separation ribs 23 bilaterally and interval arranged in parallel; tops of the U-shaped separation ribs 23 are fixedly connected to each other by a connection wall, a U-shaped groove 22 is formed between two U-shaped separation ribs 23, and a weight level indicator 59 is arranged on the connection wall close to one side of the locating plate 7; when rotating the handle, the level tag 19 turns to a position corresponding to the weight level indicator 59, i.e., the corresponding weight level.

Two locating pins in which locating holes are formed in the middle are symmetrically arranged on an end face of the main body corresponding to the circular locating plate 7, a ball compression spring 20*a* and a ball 21 are mounted in each locating hole, the diameter of the ball is larger than the aperture of the locating holes 37 of the locating plate 7. The locating plate 7 is mounted on the handle in advance, the balls partly fall into the locating holes 37 at a corresponding position under the action of the ball compression springs for location, and then roll out of the locating holes 37 when the rotating force for rotating the handle 5 is larger than the jacking force of the compression spring. As a result, this location shall be not locked but has a certain damping.

A connector is arranged in the grooves inside the U-shaped separation ribs 23 along the axial direction of the main body, a middle through hole 52 arranged coaxially with an inner hole 34 is formed in the connector, a mandrel 17 in a circumferential clearance fit with the inner hole 34 passes through the inner hole 34 and the middle through hole 52, a shaft end face of the cylindrical convex plate 31 is attached to an end face of the connector. In this way, the handle 5 achieves rotatable. The weight plate holders on the both sides are fixed on the mandrel 17 at the same angle by using the locating pins, locating screws or welding method.

Figure 1:
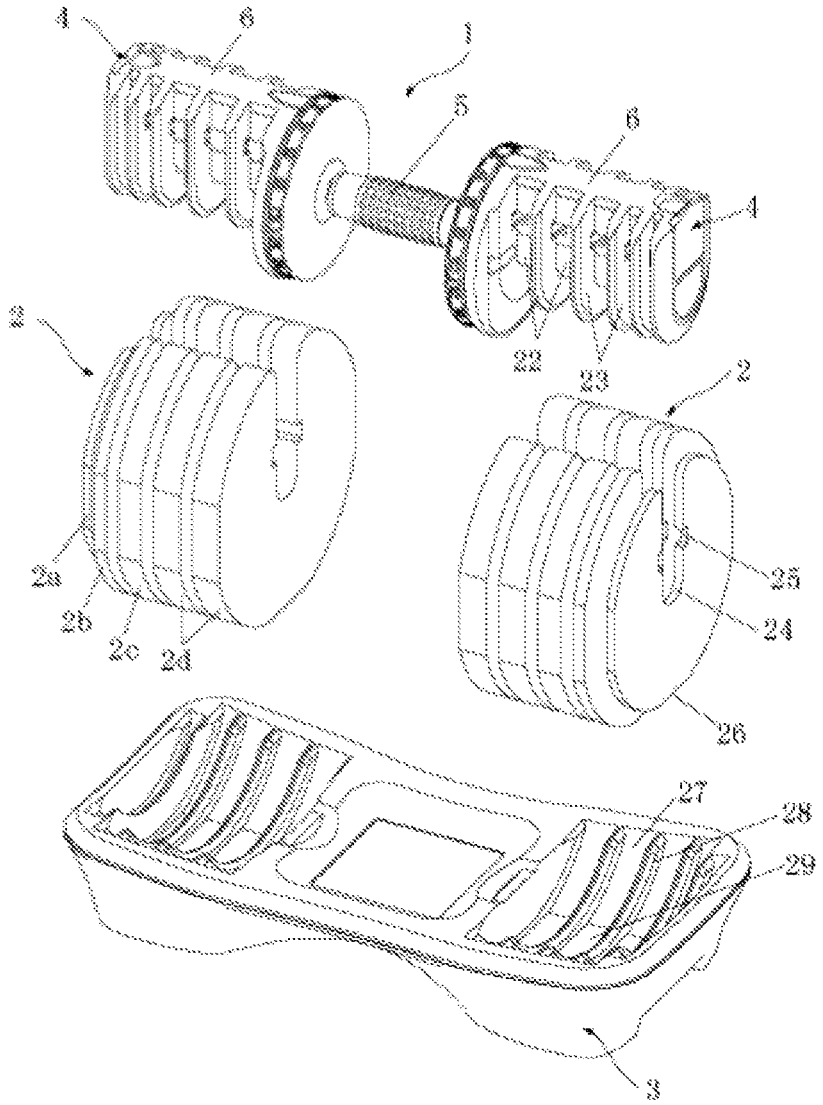
FIG. 1 is an exploded view of an adjustable dumbbell according to the present invention.
Figure 2:
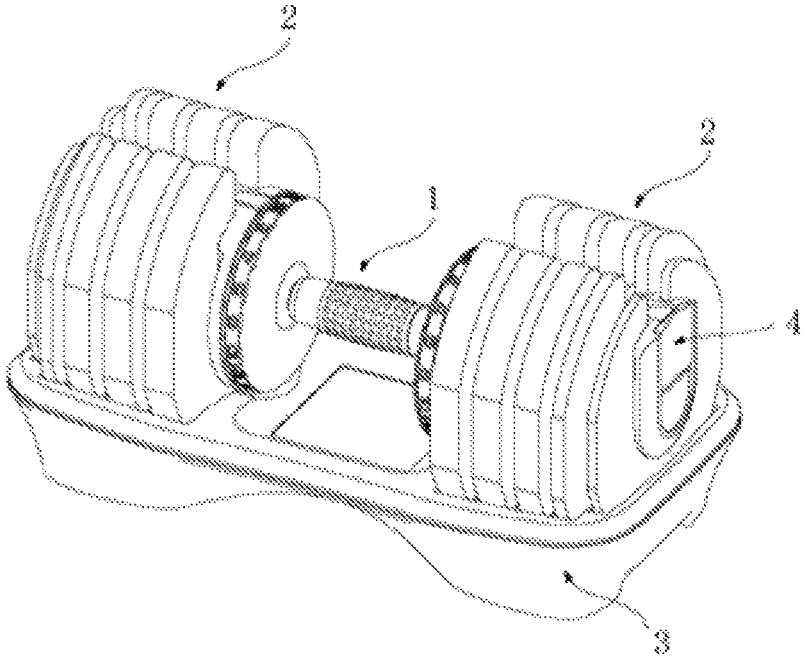
FIG. 2 is a perspective view of the adjustable dumbbell according to the present invention.
Figure 3:
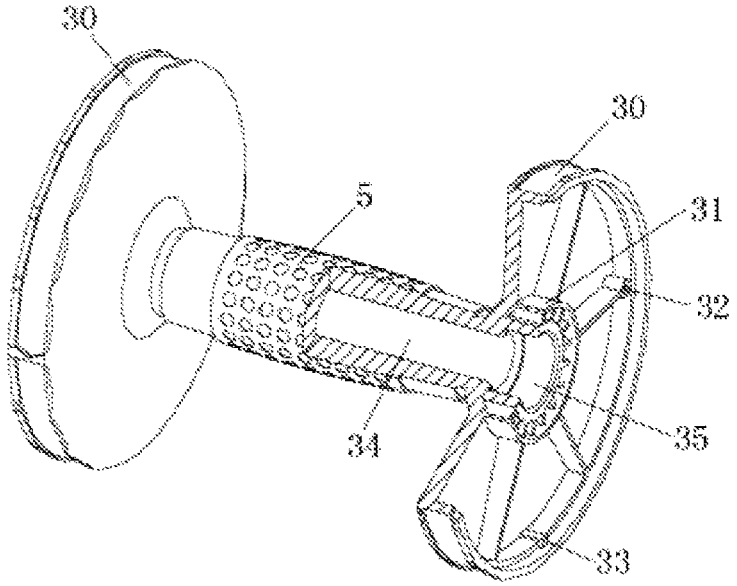
FIG. 3 is a schematic diagram of a handle of the dumbbell as shown in FIG. 2.
Figure 13:
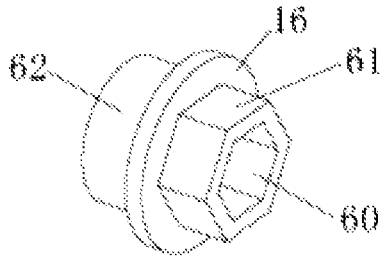
FIG. 13 is a schematic diagram of a bushing of the dumbbell as shown in FIG. 1.
Figure 14:
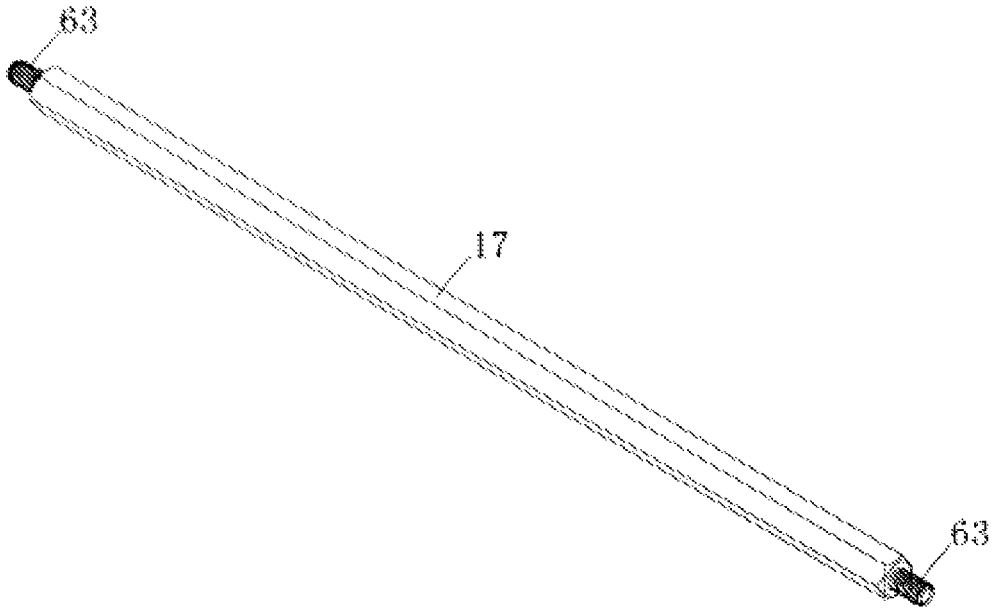
FIG. 14 is a schematic diagram of a mandrel of the dumbbell as shown in FIG. 1.

As a preferred embodiment of the present invention, With reference to FIG. 3, the inner hole 34 is a stepped hole, wherein the inner hole located at the cylindrical convex plate 31 is set as a shaft hole 35 having the diameter larger than that of the inner hole 34; as shown in FIG. 12, FIG. 12-1, FIG. 12-2 and FIG. 12-3, With reference the middle through hole 52 of the weight plate holder 6 is set as a polygonal stepped through hole; the size of the polygonal hole on one side of the middle through hole 52 close to the locating plate 7 is larger than that of the middle through hole 52 to form a large polygonal hole 54, and the size of the polygonal hole on the side away from the locating plate 7 is smaller than that of the middle through hole 52 to form a small polygonal hole 53. With reference to FIG. 13, the shaft hole 35 of the support plate at each end is connected to a pillow block 62 at one end of a bushing 16 in a clearance fit manner, and a polygonal pillow block 61 at the other end of the bushing 16 is connected to the large polygonal hole 54 in a clearance fit manner. A cylindrical convex plate, of which two end faces are respectively attached and connected to the shaft end face of the cylindrical convex plate 31 and an end face of the large polygonal hole 54, is arranged between the pillow block 62 and the polygonal pillow block 61. The thickness of the cylindrical convex plate may keep a small gap between the handle 5 and the weight plate holder 6, a polygonal hole 60 is formed in the middle of the bushing 16. With reference to FIG. 14, the polygonal hole 60 on the mandrel 17 and the bushing 16 and the small polygonal hole 53 on the main body are respectively connected to each other in a close fit manner and fixed on the connector by bolts.

The middle through hole 52 may be a hexagonal hole, and the mandrel 17 is a hexagon. Alternatively, other polygonal holes such as square holes may be adopted for the middle through hole 52, and the mandrel 17 may be other polygons such as a square. Alternatively, the middle through hole is a circular hole, and mandrel 17 is in the key connection with the circular hole. The purpose of adopting the above structure is that the weight plate holders 6 on the both ends are fixed on the mandrel 17 at an identical angle.

Figure 15:
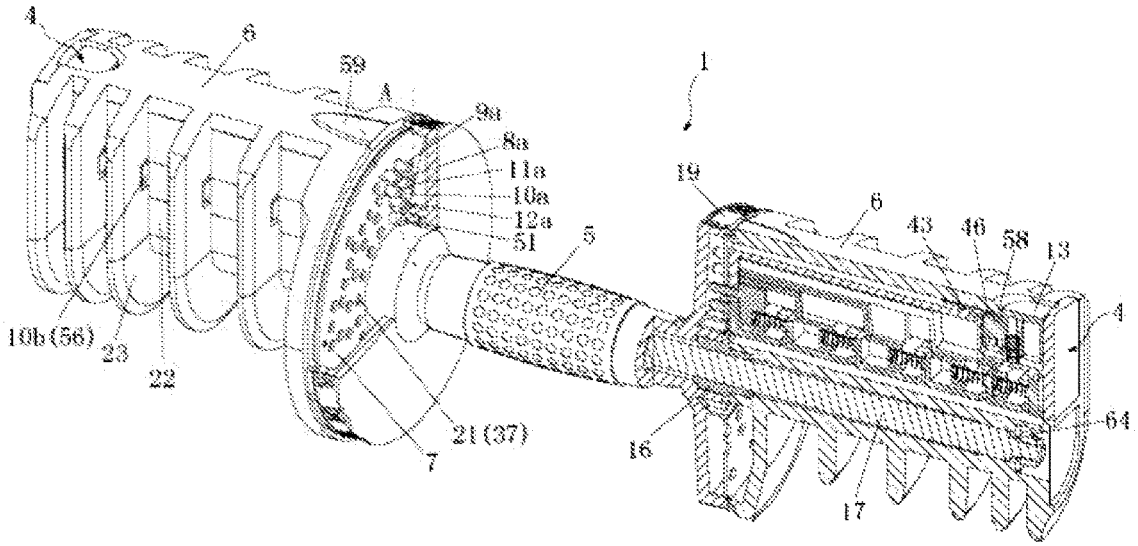
FIG. 15 is a schematic diagram of the dumbbell bar when the set of the pin cartridge is closed.

With reference As shown in FIG. 15, the mandrel 17 passes through the handle 5, the bushing 16 and the weight plate holders 6, nuts 64 at the both ends of the mandrel are screwed into studs 63 at the both ends of the mandrel 17, and the above components are connected to the mandrel 17 to prevent axial movement and are in an axial clearance fit with each other. The bushing 16 and the weight plate holders 6 are connected with the hexagonal mandrel 17 in a close fit manner so that the weight plate holders 6 at the both ends are radial fixed on the mandrel 17 at the identical angle, and the shaft hole 35 of the handle 5 is in a circumferential clearance fit with the pillow block 62 of the bushing 16. In this way, the handle 5 may rotate.

A slide rail is arranged on a top surface of the connector along the axial direction of the main body, a pin cartridge hole 55 is formed in the groove inside the U-shaped separation rib 23 above the slide rail, and set of the pin cartridges 4 mounted in the pin cartridge hole 55 are capable of gliding in the pin cartridge hole 55 and being also connected to the main body by a locking structure. Grooves 56 are symmetrically formed on front and rear side walls of the pin cartridge hole 55 corresponding to each U-shaped separation rib respectively; each set of the pin cartridge comprises a bottom pin cartridge cover 15 on which an upper pin cartridge cover 14 is fixed; and pin holes 44, which the number is the same as that of the weight plates on one side, are formed on a side wall of the upper pin cartridge cover. The upper and bottom pin cartridge covers can be integrally connected to each other by welding, gluing, using lock catches or screws and other manners.

A plurality of support walls are interval arranged in parallel inside the bottom pin cartridge cover 15 and arranged along the axial direction perpendicular to the main body; chambers 48, which the number is the same as that of the pin holes 44, are formed between the adjacent support walls. Spring locating pins 49, each being fixedly connected to an locating pin by a pin bottom compression spring 20*b*, are arranged on a side wall of each support wall corresponding to the pin holes 44, a pin head is fixed at one end of each locating pin along the horizontal direction and a pin bottom is fixed at the other end thereof, the pin head and the pin bottom are perpendicular to each other. The pin bottom compression spring 20*b* is mounted in a spring eye formed in the middle of the pin bottom of the locating pin.

Pin bottom grooves 50 are respectively formed on the front and rear side walls of the bottom pin cartridge cover 15 corresponding to each chamber 48, and each locating pin is supported on the corresponding pin bottom groove 50 by the pin bottom (a pin bottom 8*b* as shown in the figures); the length of the pin bottom is larger than the width of the bottom pin cartridge cover 15 so that front and rear ends of the pin bottom extend respectively from the pin bottom groove 50 on the corresponding sides; the width of the pin bottom groove 50 is larger than that of the pin bottom, and the pin heads of the locating pins are capable of passing through the pin holes 44 correspondingly under the elasticity of the pin bottom compression spring 20*b* and being arranged correspondingly to a set of pin holes in one sector on the locating plate. When the pin bottom compression spring is in a normal state, the pin bottom of each locating pin is respectively plugged into the groove 56 of the U-shaped separation rib 23 at the corresponding position. When the pin bottom compression spring is in a compressed state, the pin bottom of the locating pin connected to the compressed pin bottom compression spring is moved to the position between the two U-shaped separation ribs 23 along the pin bottom groove 50 and plugged into weight plate grooves 25 corresponding thereto on the weight plates, so that the locating pins are fixedly connected to the weight plates. A locating pin 51 is arranged on an end face of the bottom pin cartridge cover 15 at the same end as the pin hole, and is plugged into, locked with and connected to the locating holes corresponding thereto on the locating plate 7.

Figure 6:
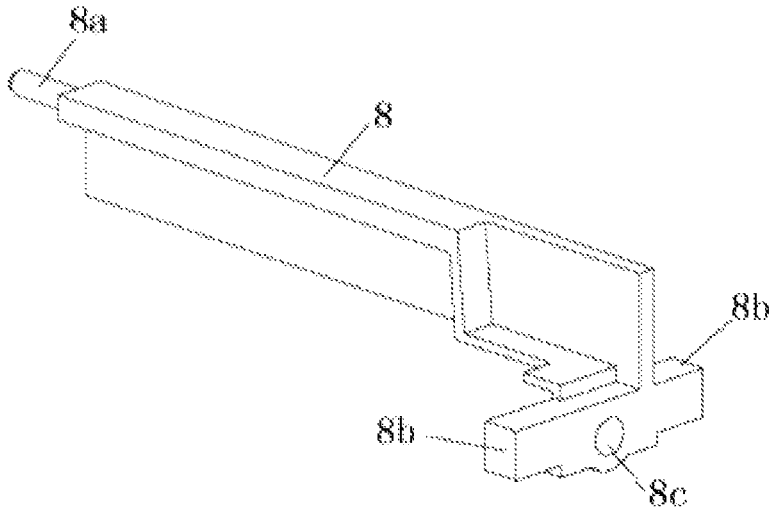
FIG. 6, FIG. 7, FIG. 8, FIG. 9 and FIG. 10 are structural diagrams of five locating pins of an embodiment of the dumbbell according to the present invention, respectively.
Figure 7:
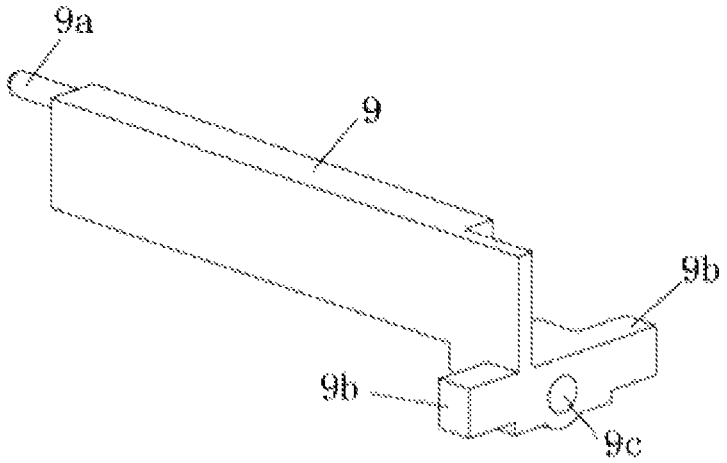
Figure 8:
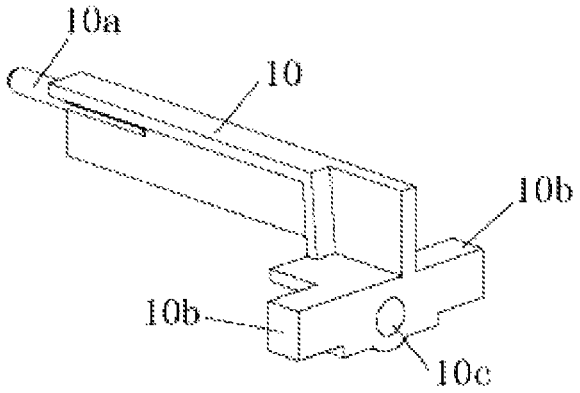
Figure 9:
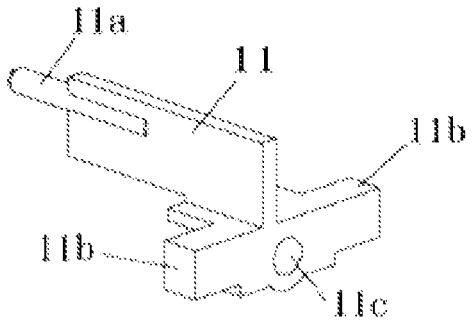
Figure 10:
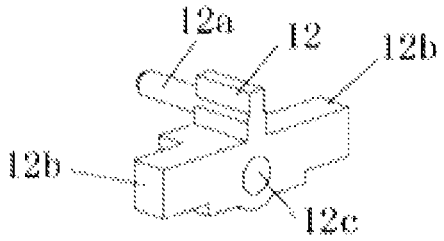
Figure 11:
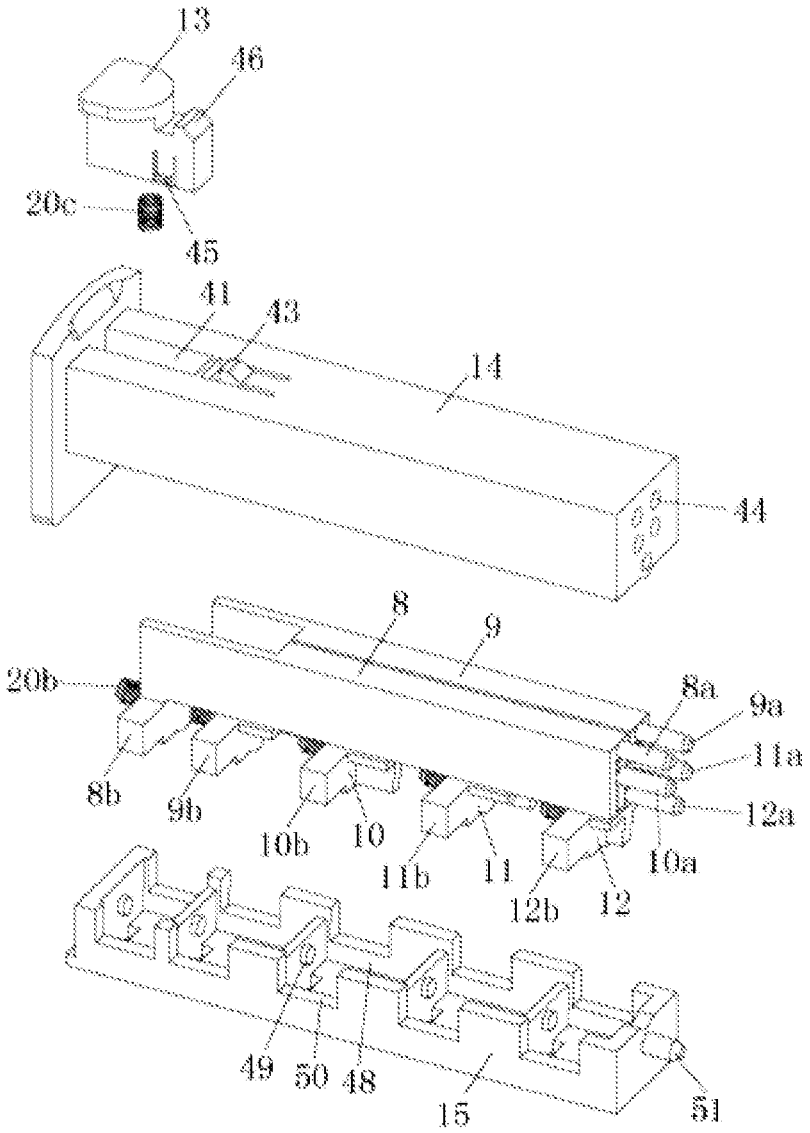
FIG. 11 is an exploded view of a set of set of the pin cartridge of the dumbbell according to the present invention.
Figures 1, 11:
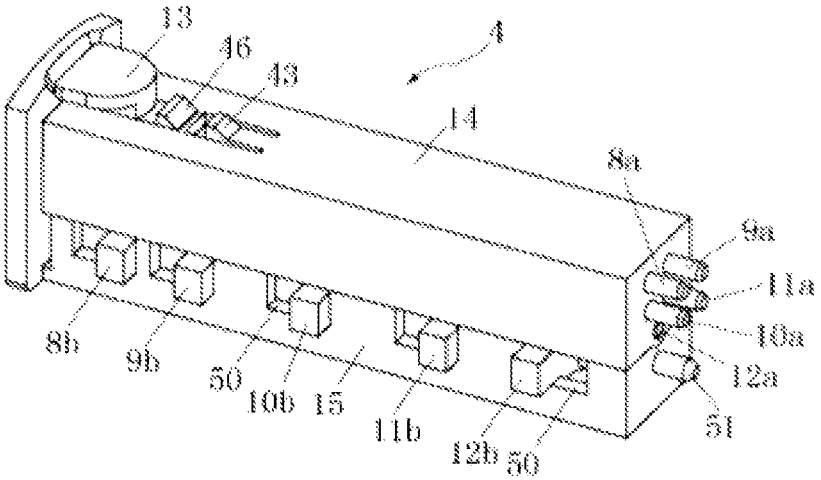
Figures 2, 11:
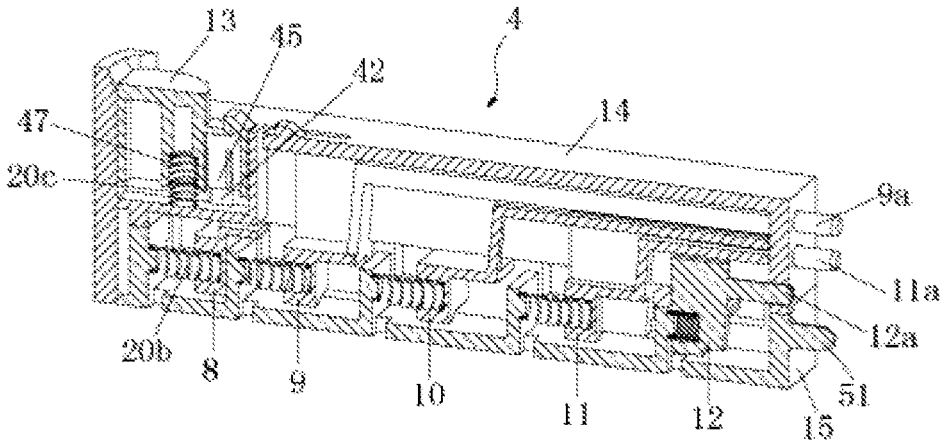
Figure 12:
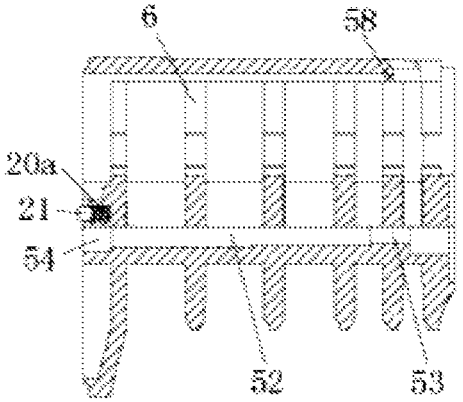
FIG. 12 is a section view on the line E-E of a weight plate holder as shown in FIG. 12-1.
Figures 1, 12:
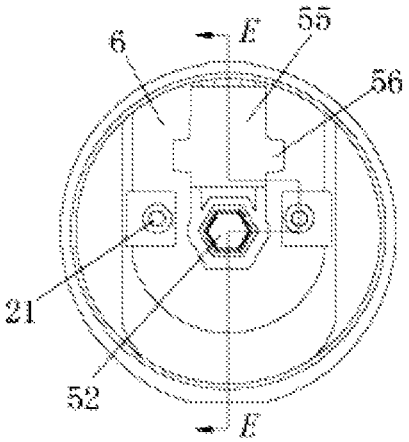
Figures 2, 12:
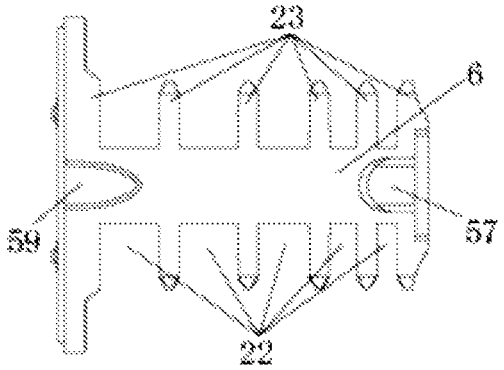
Figures 3, 12:
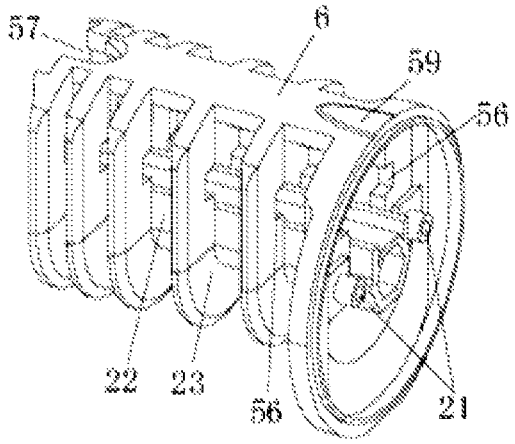

The present invention describes the working operation of the locating pins by taking five locating pins 8, 9, 10, 11 and 12 as examples. With reference to FIG. 6, a pin head 8*a*, a pin bottom 8*b* and a spring eye 8*c* are arranged on the locating pin 8. Similarly, all the locating pins 9, 10, 11 and 12 are provided with the pin heads, the pin bottoms and the spring eyes. As shown in FIGS. 7, 8, 9, 10, 11-1 and 11-2, when there are pin holes corresponding to the pin heads 8*a*, 9*a*, 10*a* and 11*a* in one sector on the locating plate 7, the corresponding pin bottoms 8*b*, 9*b*, 10*b* and 11*b* are close to the right side wall of the pin bottom groove 50. When there is no pin hole corresponding to the pin head 12*a* in one sector on the locating plate 7, the locating pin is tightly resisted against the pin head 12*a* for compression, the locating pin compression spring is compressed so that the pin head 12*a* is retracted into the pin hole 44, and the pin bottom 12*b* is close to a left side wall of the pin bottom groove 50.

As a preferred embodiment of the present invention, the locking structure comprises a button slot 41 on the upper pin cartridge cover 14, and snap holes 42 are formed on front and rear side walls of the button slot, respectively, and a button 13 is mounted in each button slot 41; a button compression spring 20*c* is mounted in a spring eye 47 of the button 13, so that the button 13 can be prevented from popping up by hooking elastic buckles 45, which is located on the front and rear sides of the button 13, on to a hole wall of the snap hole 42 (the principle is the same as that of the elastic buckle 43), and a barb 46 is arranged on an inner top surface of the button 13, and the barb 46 of the button 13 is exposed from an upper plane of the upper pin cartridge cover 14 under the elasticity of the button compression spring 20*c*; when the button 13 is pressed, the barb 46 is retracted into the button slot 41 and lower than the upper plane of the upper pin cartridge cover 14. A locking platform 58 is downwardly protruded on a bottom wall of the connection wall of the weight plate holder 6, and a gap 57 having the button 13 inside is formed on an outside of the connection wall. The barb 46 is capable of being hooked on to or released from the locking platform 58 under the action of the button compression spring, a locating elastic buckle 43 higher than the upper plane of the upper pin cartridge cover 14 is arranged on the upper pin cartridge cover 14 located on an inner side of the button slot 41, a rounding chamfer is arranged at an entry end of the locating elastic buckle 43 entering into the pin cartridge hole, and U-shaped holes are formed on the upper pin cartridge cover 14 provided with the locating elastic buckles which material is flexible. When the set of the pin cartridges are pulled outwards, the locating elastic buckles 43 are resisted against an end face inside the locking platform 58 and then located to prevent the set of the pin cartridges from slipping off, and the pin bottoms of all the locating pins are respectively clamped in the weight plate grooves 25 corresponding thereto.

When the balls 21 fall into the locating holes 37 for damping location, the locating pins on the set of the pin cartridge 4 pass through the corresponding locating holes on a locating plate, and the set of the pin cartridges 4 are assembled into the weight plate holders 6 at the both ends, the entry end of the locating elastic buckle 43 is provided with the rounding chamfer for passing through the locking platform 58, and then locked by hooking the barb 46 of the button 13 on to the inner wall of the locking platform 58. Meanwhile, the locating pins 51 on the set of the pin cartridge 4 pass through the locating holes 37 on the locating plate 7, and the handle 5 is locked from rotating by the weight plate holders 6.

Alternatively, the locking structure may adopt the locating pins and the locating holes, and other existing structures.

The U-shaped separation ribs 23 at both ends are plugged between the two adjacent weight plates of the weight plate sets 2 at both ends correspondingly, the weight plates are clamped between the separation ribs 23 on the both sides, thus the axial movement and the radial rotation of the weight plates are both located. A U-shaped weight plate groove 24 is arranged in the middle of an upper portion of each weight plate, and weight plate grooves 25 are symmetrically formed on front and rear vertical side walls of each U-shaped weight plate groove 24; a horizontal support surface 26 is arranged on a bottom wall of the weight plate. The weight plates in the weight plate sets 2 are arranged by a supporting manner in a plurality of arc-shaped grooves 27 of the base 3 by the horizontal support surface 26 at the bottom, and each weight plate is clamped in the correspondingly arranged arc-shaped grooves 27 of which the shape is matched with that of the bottom of the weight plate so that all the U-shaped weight plate grooves 24 are completely overlapped along the axial direction.

As shown in the figures, the weight plate sets 2 at the both ends are symmetrically placed, and the weight plates at each end arranged from heavy weight to light weight are arranged inside out as shown in FIGS. 2*d*, 2*c*, 2*b* to 2*a*. The weight plates have the same shape, only the outer diameter and the thickness thereof are changed with weight.

A plurality of the arc-shaped grooves 27 and separation ribs 28 are arranged at the both ends of the base, and a horizontal support surface 29 is arranged at the bottom of the arc-shaped groove 27. The number of the arc-shaped grooves 27 is the same as that of the weight plates, each weight plate is clamped in the arc-shaped base groove 27 by the separation ribs 28 on the both side thereof, the support surface 26 of the weight plate is overlapped with the support surface 29 of the base, thereby ensuring that all the U-shaped weight plate grooves 24 are completely overlapped along the axial direction.

A method of using the dumbbell according to present invention is described below:

As shown in the figures, when the weight level indicator 59 indicated the group A of the locating plate 7, the pin heads of the five locating pins 8*a*, 9*a*, 10*a*, 11*a* and 12*a* pass through the five pin holes of the group A, and the pin bottoms of the five locating pins are hidden in the grooves 56 on the separation ribs 23, and the pin bottoms shall not carry any weight plates accordingly. The minimum working weight of the dumbbell is the dumbbell bar 1 itself for exercises only, i.e., the weight of the dumbbell bar 1 itself.

Figure 16:
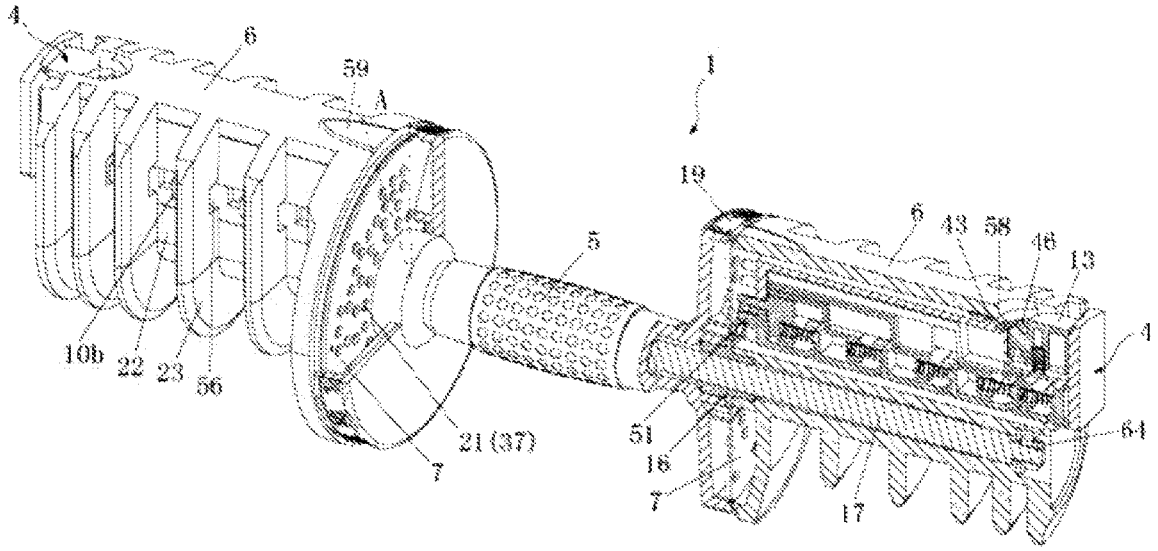
FIG. 16 is a schematic diagram of the dumbbell bar when the set of the pin cartridge is pulled out.

With reference to the dumbbell bar 1 as shown in FIG. 16, when adjusting the weight, the buttons 13 at the both ends are pressed while the set of the pin cartridges 4 are pulled out, the set of the pin cartridges 4 will be stopped at a position when the locating elastic buckle 43 is resisted against the inner wall of the locking platform 58, and the locating pins 51 and all the pin heads on the set of the pin cartridges 4 are departed from the locating plate 7 at a certain distance, so that the handle 5 may be freely rotated to a position at the desired weight level. Meanwhile, all the pin bottoms are also moved from the grooves 56 in the separation ribs 23 to the positions between the two separation ribs 23, i.e., the positions of the weight plates between the two separation ribs 23, and the pin bottoms are clamped in the weight plate grooves 25 to avoid dropping out. Such arrangement has the following significant advantages: when using the dumbbell bar 1 together with the weight plates, the weight plates will not drop out from the dumbbell bar 1 even if the pin cartridges 4 are pulled out by mistake.

When the dumbbell bar 1 is placed together with the weight plates and the base (see FIG. 2), the set of the pin cartridges 4 are pulled out without being closed, and all the pin bottoms are moved from the grooves 56 on the separation ribs 23 to the position between the two separation ribs 23 and then clamped in the weight plate grooves 25, thus the dumbbell bar shall be lifted up with all the weight plates together.

Figure 17:
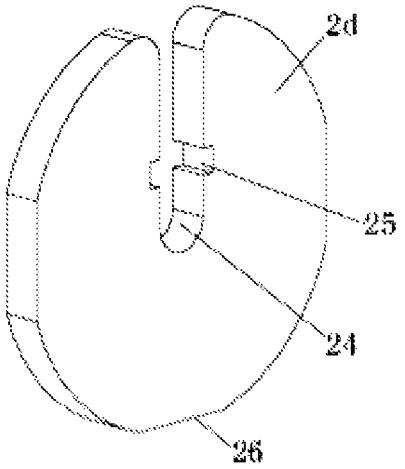
FIG. 17 is a schematic diagram of a weight plate of the dumbbell as shown in FIG. 1.
Figures 1, 17:
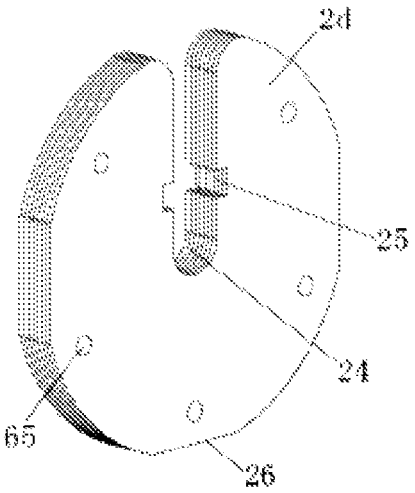

With reference to FIGS. 17 and 17-1, the shape of weight plates 2 are basically the same and the outer diameter and the thickness of the bell are changed with weights. As long as the structure, dimensional accuracy and weight meet the design requirements, there is no restriction on the material and the process of the weight plate. As shown in FIG. 17, the weight plate may not only be machined by entire steel plate, cast iron or other metal materials, but also be assembled by filling iron sand, cement or water and other mixed materials in a blow molding hollow body. As shown in FIG. 17-1, the weight plate may also be assembled by multilayer plates by riveting (riveting by rivets 65 as shown in FIG. 17-1), welding or screw connection, and so on.

Figure 18:
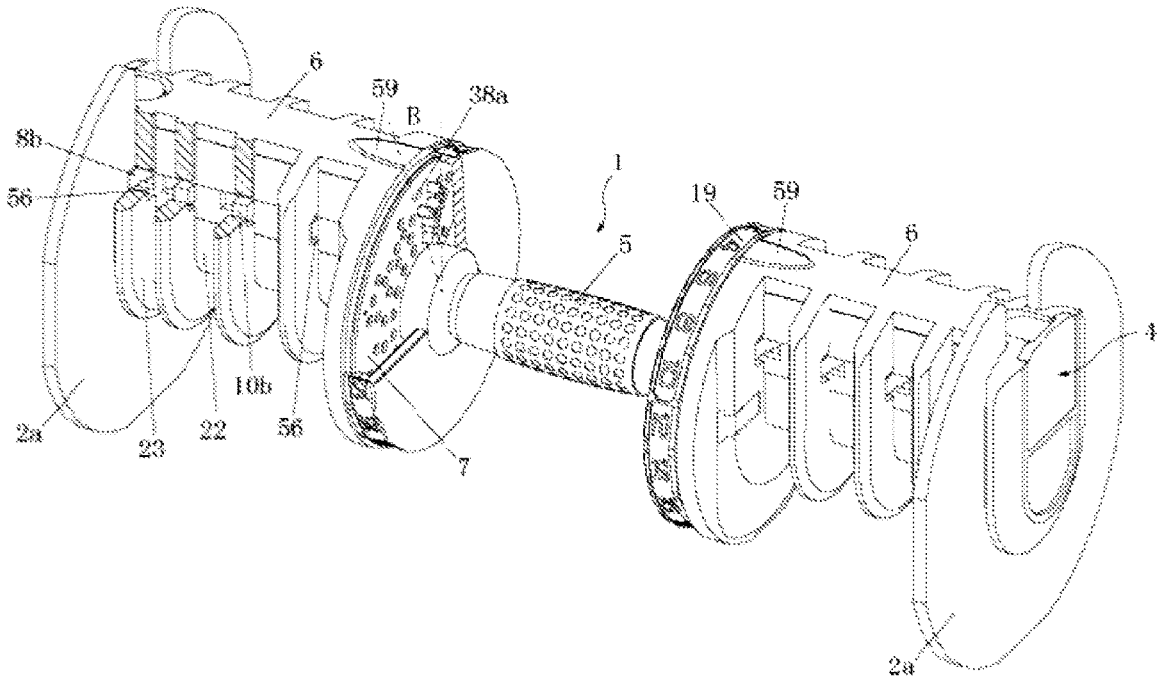
FIG. 18 is a schematic diagram where the weight plates are lifted up by the dumbbell bar located at a group B of pin holes.

With reference to FIG. 18, when the set of the pin cartridges 4 are in the locked state and the weight level indicator 59 indicates group B of the locating plate 7, a pin hole 38A corresponding to the pin head 8*a* is hidden, and the pin head 8*a* is retracted into the pin hole 44, the pin bottom 8*b* is moved from the groove 56 in the separation rib 23 into the U-shaped groove 22, and clamped inside the weight plate groove 25 of the weight plate 2*a*. When the dumbbell bar 1 is placed together with the weight plates and the base, as shown in FIG. 2, the dumbbell bar 1 shall be lifted up with the weight plate 2*a* together.

Figure 19:
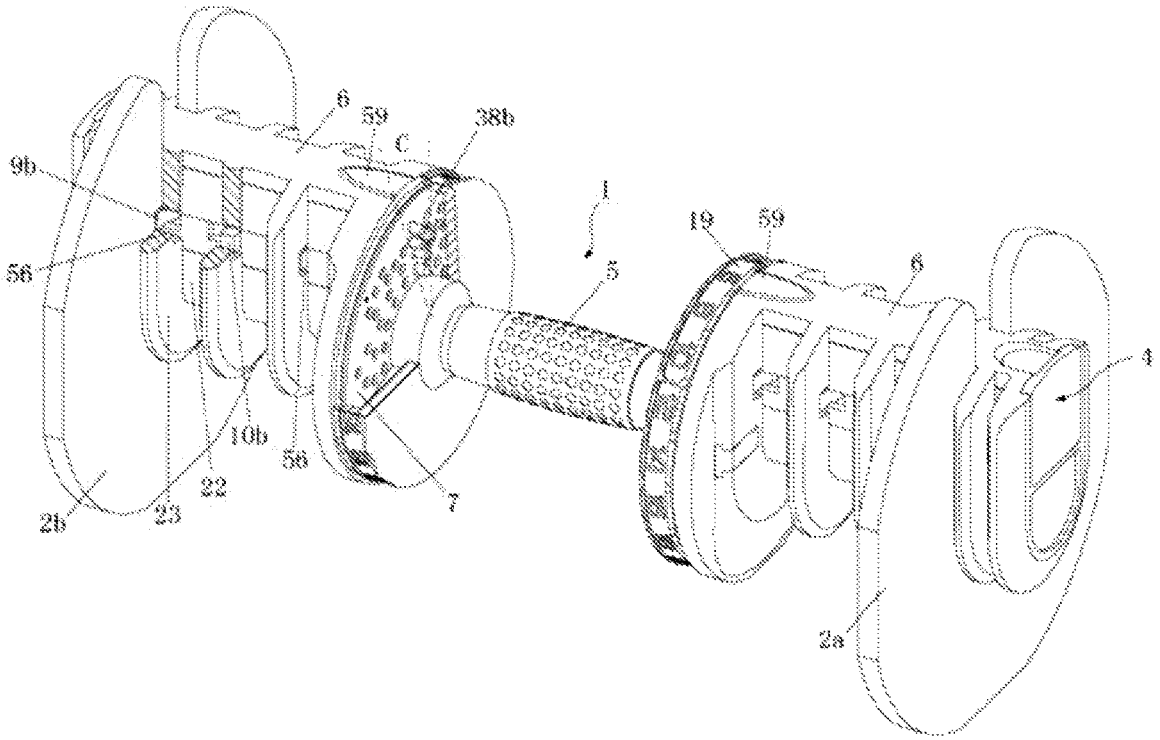
FIG. 19 is a schematic diagram where the weight plates are lifted up by the dumbbell bar located at a group C of pin holes.

With reference to FIG. 19, when the set of the pin cartridges 4 are in the locked state and the weight level indicator 59 indicates group C of the locating plate 7, a pin hole 38*b* corresponding to the pin head 9*a* is hidden, and the pin head 9*a* is retracted into the pin hole 44, the pin bottom 9*b* is moved from the groove 56 in the separation rib 23 into the U-shaped groove 22, and is clamped inside the weight plate groove 25 of the weight plate 2*b*. When the dumbbell bar 1 is placed together with the weight plates and the base, as shown in FIG. 2, the dumbbell bar 1 shall be lifted up with the weight plate 2*b* together.

Figure 20:
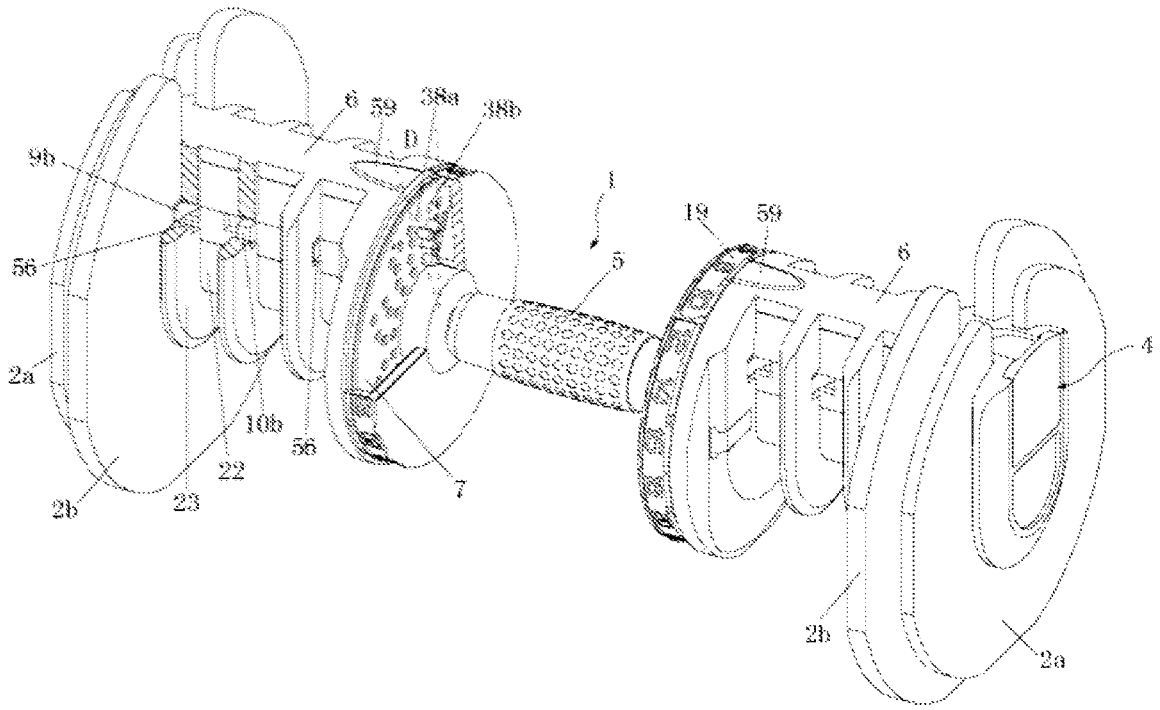
FIG. 20 is a schematic diagram where the weight plates are lifted up by the dumbbell bar located at a group D of pin holes.

With reference to FIG. 20, when the set of the pin cartridges 4 are in the locked state and the weight level indicator 59 indicates group D of the locating plate 7, the pin holes 38*a* and 38*b* corresponding to the pin heads 8*a* and 9*a* are hidden, and the pin heads 8*a* and 9*a* are retracted into the pin holes 44, the pin bottoms 8*b* and 9*b* are moved from the groove 56 in the separation rib 23 into the U-shaped groove 22, and are clamped inside the weight plate groove 25 of the weight plates 2*a* and 2*b*. When the dumbbell bar 1 is placed together with the weight plates and the base, as shown in FIG. 2, the dumbbell bar 1 shall be lifted up with both the weight plates 2*a* and 2*b* together.

Similarly, adjusting the handle to make the weight level indicator 59 indicating to the different sets of pin holes in the locating plate 7, different weight plates or combination of the weight plates will be lifted up. The minimum working weight of the dumbbell is the dumbbell bar 1 itself and the maximum working weight thereof is the sum of all the weight plates and the dumbbell bar 1.

Figure 21:
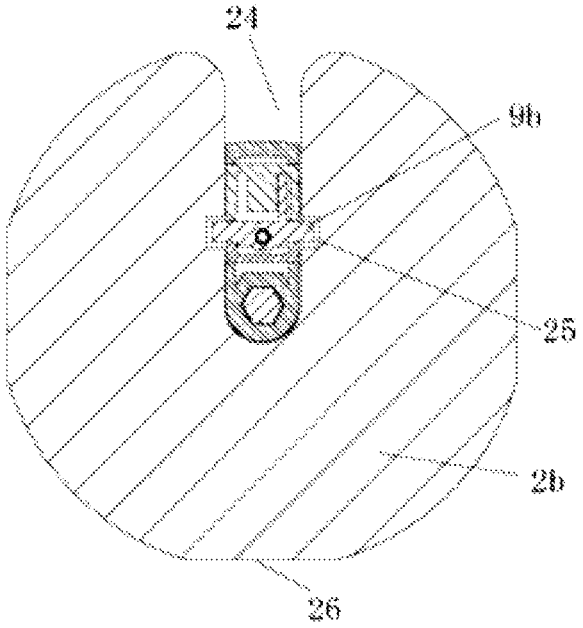
FIG. 21 is a sectional view when the weight plates are lifted up.

FIG. 21 shows a sectional view of a weight plate 2*b* being lifted up by the dumbbell bar 1, the length of the pin bottom 9*b* is larger than the width of the U-shaped weight plate groove 24, and the pin bottom is clamped in the weight plate groove 25 so that the weight plate will not drop out.

Figure 22:
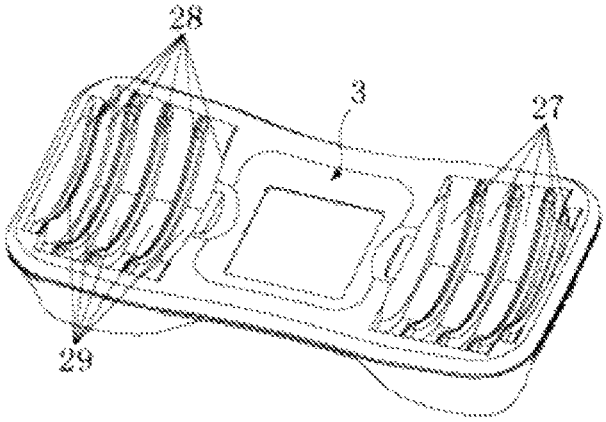
FIG. 22 is a schematic diagram of a base of the dumbbell as shown in FIG. 1.
Figure 23:
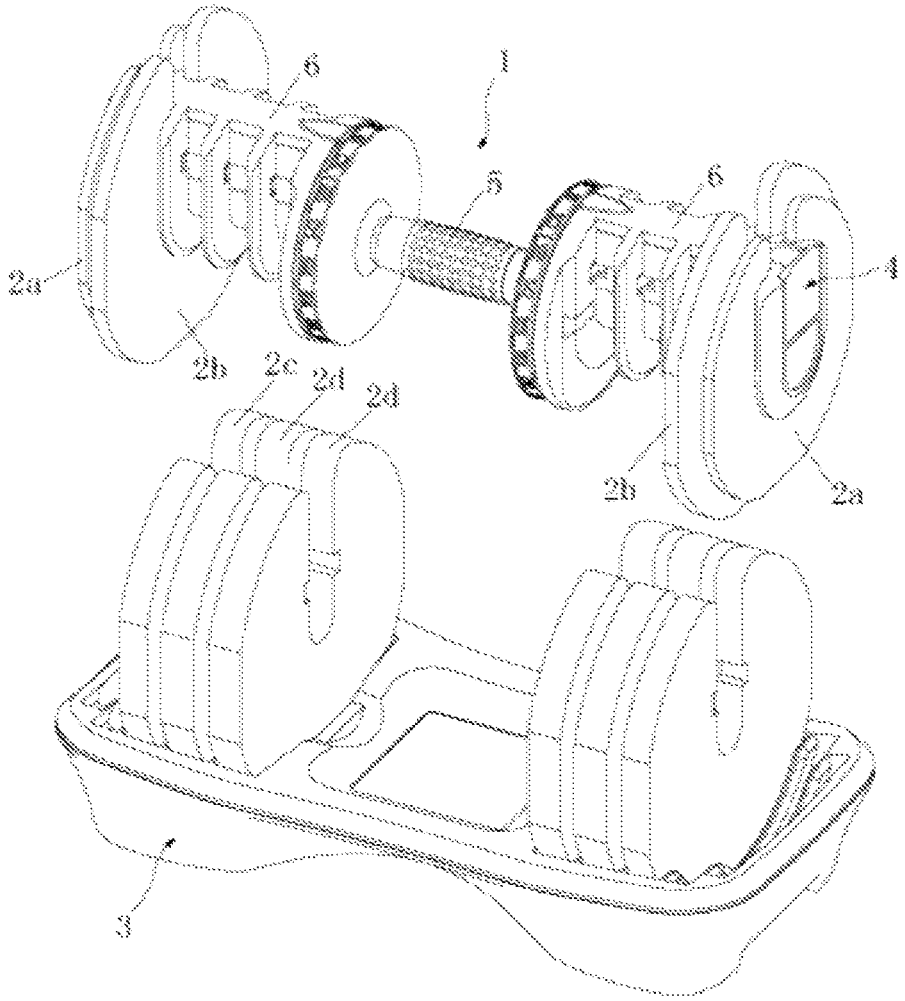
FIG. 23 is an overall schematic diagram of the adjustable dumbbell where the weight plates are lifted up by the dumbbell bar located at the group D of the pin holes.

With reference to FIG. 22 and FIG. 23, the separation ribs 28 on the base 3 keep the weight plates inside the arc-shaped grooves 27 in a standing state, and the support surface 29 at the bottom is completely overlapped with the support surface 26 of the weight plates, thereby ensuring that all the U-shaped weight plate grooves 24 are completely overlapped along the axial direction, and the dumbbell bar 1 may be plugged or lifted up smoothly. When using the dumbbell, the weight plates which are not lifted up are still standing on the base, thus the weight plates of the dumbbell are placed neatly.

Those described above are merely preferred embodiments of the present invention, and are not intended to limit the present invention in any form. Any simple modifications, equivalent variations and embellishments made to the above embodiments according to the technical essence of the present invention still fall within the protection scope of the technical solution of present invention.

What is claimed is:

1. A weight-adjustable dumbbell, comprising a handle bar having a middle section and two end sections, a handle, two weight plate holders, two pin cartridges, a plurality of weight plates and a base; the handle being concentrically and rotatably installed on the middle section of the handle bar, each of the two weight plate holders being fixedly attached to a respective one of the two end sections of the handle bar; each of the two pin cartridges being removably hosted inside a respective one of the two weight plate holders; each of the plurality of weight plates being detachably connected to either of the two weight plate holders or disconnected from either of the two weight plate holders and removably rested on the base; where:

each of the two pin cartridges comprises a plurality of pins and each of the plurality of pins comprises a pin head and a pin bottom, and each of the plurality of pins independently assumes a normal position or an extended position and independently changes between the two positions by a lateral translocation;

each of the plurality pins is corresponding to one of the plurality of weight plates in that when a pin assumes an extended position a corresponding weight plate of the plurality of weight plates is locked to one of the two weight plate holders; and as a way of adjusting the dumbbell weight, a rotation of the handle bar to a predefined position relative to the two weight plate holders causes the lateral translocation of one or more of the plurality of pins so that at least one pin of the plurality of pins changes from the normal position to the extended position and/or at least one pin of the plurality of pins changes from the extended position to the normal position to result in a different set of pins of the plurality of pins being in the extended position and hence a different set of weight plates of the plurality of weight plates being attached to the two weight plate holders.

2. The weight-adjustable dumbbell according to claim 1, wherein the two pin cartridges each assume two states, a closed state and an open state, and in the open state, all of the plurality of pins assume the normal position and the handle bar is allowed to rotate relative to the two weight plate holders, while in the closed state one or more of the plurality of pins assumes the extended position, thereby preventing the rotation of the handle bar relative to the two weight plate holders and at the same time locking one or more of the plurality of weight plates to one of the two weight plate holders.

3. The weight-adjustable dumbbell according to claim 2, wherein the handle has two ends and each of the two ends comprises a support plate and a circular locating plate, which are fixedly connected to the handle and thus concentrically rotatable together with the handle relative to the two weight plate holders;

the circular locating plate comprises a plurality of fan-shaped sectors, each of the plurality of fan-shaped sectors having a plurality of holes, and each of the plurality of holes capable of receiving one pin head of the plurality of pins extending out of one of the two weight plate holders; and with the two pin cartridges in the open state inside the two weight plate holders, none of the plurality of holes of the circular locating plate receives any pin head of the plurality of the pins, while with the two pin cartridges in the closed state, at least one of the plurality of holes receives one pin head of the plurality of the pins extending out of one of the two weight plate holders, thereby preventing the rotation of the handle relative to the two weight plate holders.

4. The weight-adjustable dumbbell according to claim 3, wherein each of the plurality of weight plates comprises a first groove and two second grooves and, with the two pin cartridges in the closed state, at least one of the plurality of pins has the pin head inserted into one of the plurality of holes of the circular locating plates and the pin bottom inserted into the second grooves of one of the plurality of weight plates, thereby locking the corresponding weight plate to one of the two weight plate holders.

5. The weight-adjustable dumbbell according to claim 4, wherein the dumbbell has two states: an operating state in which the two pin cartridges are in the closed state, the handle is not rotatable relative to the two weight plate holders and the dumbbell is ready to be used by a user; and a weight adjusting state in which the two pin cartridges are in the open state, the handle is rotatable relative to the two weight plate holders to one of predefined positions and the dumbbell is changeable to a predetermined weight according to a value marked for each of the predefined positions which the handle is rotated to.

6. The weight-adjustable dumbbell according to claim 4, wherein each of the predefined positions, to which the handle is configured to be rotated, defines an alignment of one of the plurality of fan-shaped sectors of the circular locating plate with one end of one of the two pin cartridges, and such alignment allows a set of the pin heads of the plurality of pins respectively being inserted into a set of the plurality of holes within the sector of the plurality of fan-shaped sectors of the circular locating plate.

7. The weight-adjustable dumbbell according to claim 1, wherein each of the plurality of weight plates has a first groove and two second grooves which are symmetric so that each plate of the plurality of weight plates fits either of the two weight plate holders, and each plate of the plurality of weight plates is configured to flip sides but still fits either of the two weight plate holders and the base.

8. The weight-adjustable dumbbell according to claim 1, further comprising a locking structure linked to a locating pin, capable of locking one of the two pin cartridges in the closed state in which the locating pin extending from one of the two pin cartridges is inserted into a corresponding locating hole in the circular locating plate.

9. The weight-adjustable dumbbell according to claim 1, wherein the base comprise a number of arc-shaped grooves separated by separation ribs, and each of the number of arc-shaped grooves is for holding one of the plurality of weight plates when the dumbbell is in the process of adjusting its weight by rotating the handle relative to the two weight plate holders or when the dumbbell is not in use.

* * * * *